United States Patent [19]

Davies

[11] Patent Number: 4,836,139

[45] Date of Patent: Jun. 6, 1989

[54] ADHESIVE-APPLYING APPARATUS

[75] Inventor: John Davies, Syston, England

[73] Assignee: British United Shoe Machinery Ltd, Leicester, England

[21] Appl. No.: 146,412

[22] Filed: Jan. 21, 1988

[30] Foreign Application Priority Data

Jan. 30, 1987 [GB] United Kingdom ..... 8702151

[51] Int. Cl.[4] ..... B05C 11/00

[52] U.S. Cl. ..... 118/696; 118/111; 118/244; 118/258; 118/266; 118/267; 118/697; 118/698; 118/710; 118/711

[58] Field of Search ..... 118/710, 711, 697, 698, 118/244, 255, 266, 267, 111, 696

[56] References Cited

U.S. PATENT DOCUMENTS

| | | | |
|---|---|---|---|
| 1,899,316 | 2/1933 | Dehuff | 118/258 |
| 4,387,002 | 6/1983 | Knecht | 118/711 X |
| 4,605,569 | 8/1986 | Shimada et al. | 118/266 X |

FOREIGN PATENT DOCUMENTS

| | | | |
|---|---|---|---|
| 2431842 | 2/1980 | France | 118/111 |

OTHER PUBLICATIONS

European patent application No. 0 091 321, 10/12/1983.
European patent application No. 0 043 645, 1/13/82.

*Primary Examiner*—Stanley Silverman

[57] ABSTRACT

In a computer-controlled adhesive-applying apparatus an adhesive applicator device (20) is guided along a desired path in respect of three axes according to a programmed instruction instruction in the form of digitized co-ordinate axis values, said device comprising a nozzle (384) having a ball (392) by which the flow of adhesive is controlled and which also, by engagement with the work, determines the heightwise position of the device, together with a brush assembly (398) comprising a set of bristles (404) secured to the nozzle housing (384) and surrounding it, with ends of the bristles projecting beyond the end face (384*a*) of the housing and ball. The nozzle housing (384) and brush assembly (398) are mounted for rotation whereby adhesive supplied via the nozzle is spread on the workpiece surface. In addition, the nozzle housing (384) and brush assembly (398) can "float" to accommodate irregularities in the heightwise contour of the workpiece surface. Means (200, 202, and 406 to 420) is also provided for tilting the device in order to maintain its axis perpendicular to the surface portion on which it is operating.

18 Claims, 5 Drawing Sheets

ADHESIVE-APPLYING APPARATUS

BACKGROUND OF THE INVENTION

This invention is concerned with an adhesive-applying apparatus whereby adhesive is supplied to marginal portions of components, e.g. to marginal portions of the bottom of lasted shoes.

In applying adhesive to components, it is often necessary, or at least highly desirable, that the applied adhesive is closely controlled as to its area of application; for example, in applying adhesive to marginal portions of shoe bottoms it is desirable that the applied adhesive follows closely the edge of the shoe bottom, thus ensuring a bond between the shoe bottom and an outsole as closely to the edge as is practicable, but without the applied adhesive extending beyond the area which will subsequently be covered by the outsole, since that would give rise to an unsightly appearance in the finished shoe.

In general the application of adhesive to a shoe bottom is carried out manually, in order that the necessary degree of accuracy can be achieved, although it will be appreciated that, by relying upon manual operation, human error is likely to arise, especially towards the end of a working day when the operator's concentration and dexterity is likely to diminish.

OBJECTS OF THE INVENTION

It is one of the various objects of the present invention to provide an adhesive-applying apparatus whereby adhesive is progressively applied to marginal portions of components, wherein, as the adhesive is so progressively applied, it is spread to form an adhesive stripe of acceptably uniform thickness and width, which stripe is also provided with a sharply defined edge extending along the edge of the marginal portion to which the stripe is applied.

It is another of the various objects of the present invention to provide an improved adhesive applicator nozzle in which a controlled flow of adhesive can be achieved together with enhanced uniformity of adhesive spread, but wherein the risk of "drooling" is minimised.

SUMMARY OF THE INVENTION

The invention thus provides adhesive-applying apparatus whereby adhesive is applied to marginal portions of components, comprising a support for supporting a component with a surface thereof exposed to which adhesive is to be applied, an adhesive applicator device, means for effecting relative movement of approach and separation between the support, and the device to bring the device into operative engagement with a component supported by the support and means for effecting relative movement between the support and device in directions both lengthwise and widthwise of the exposed surface of a component supported by the support whereby the device is caused to follow a desired path along a marginal portion of said surface, wherein the device comprises a nozzle having an end face providing an outlet through which the flow of adhesive is controlled, a brush assembly comprising bristles which extend in a direction lengthwise of the nozzle and project beyond the end face, the bristles being disposed about the whole of the periphery of the nozzle, and drive means for effecting rotation of the brush assembly about an axis extending lengthwise of the nozzle for spreading adhesive supplied through said outlet.

It will be appreciated that, by providing such an apparatus, it becomes possible to provide for the automatic application of adhesive to marginal portions of components, e.g. marginal portions of shoe bottoms, in the operation of which apparatus the application of adhesive is closely controlled both as to the location of the applied adhesive stripe and the definition thereof, giving rise to controlled uniformity of applied adhesive and width of the adhesive stripe.

It has been found that the direction of rotation of the brush assembly is of importance especially in respect of achieving a sharply defined edge to the adhesive stripe applied. In order to ensure that the direction of rotation of the brush assembly is appropriate, bearing in mind that the direction of relative lengthwise movement between the support and the device may vary according to the particular operation, preferably the drive means for the brush assembly comprises a reversible motor, and furthermore means is provided by which, in accordance with the direction of relative lengthwise movement between the support and device along a marginal portion of the surface of a component as aforesaid, the direction of rotation of the brush assembly is determined.

Moreover, where the support is adapted to support a lasted shoe with a bottom thereof uppermost and exposed, said means for determining the direction of rotation of the brush assembly is conveniently constituted by means for determining whether the shoe to be operated upon is a left or a right, said means conveniently also being effective to determine the direction of relative lengthwise movement between the support and device. It will of course be appreciated that the direction of relative lengthwise movement between the support and device may be determined according to whether the shoe being operated upon is a left or right.

It has been found that, so far as the achieving of a sharply defined edge to the adhesive stripe is concerned, the desired direction of rotation of the brush assembly is dependent upon the nature of the surface to which the adhesive is being applied. Thus, in one mode of operation of the apparatus the brush assembly is caused by the drive means to rotate in a direction such that the bristles preceding the nozzle, as relative lengthwise movement takes place between the support and device, wipe inwardly away from the edge of the component surface. In another mode of operation, on the other hand, the brush assembly is caused to rotate in a direction such that the bristles trailing the nozzle, as such lengthwise relative movement takes place, wipe inwardly away from the edge of the component surface. The desired direction of rotation of the brush assembly is thus to be determined e.g. by the operator in accordance with the nature of the component surface.

It has also been found to be desirable, when operating on components which have a pronounced three-dimensional contour, e.g. high-heeled ladies' shoes, to maintain the axis of the nozzle housing substantially perpendicular to the component surface and to this end, in a preferred embodiment, the device is mounted for tilting movement about an axis extending transversely of the component support and tilt means is provided for effecting tilting movement of the device about said axis. In general, furthermore, it has been found satisfactory to use a multi-position tilt means which causes the device to be moved to one of a plurality of pre-set tilt conditions. Alternatively, for infinitely variable tilt of the device, more especially in an apparatus wherein the means for effecting relative lengthwise and widthwise movement between the support and the device comprises first and second n.c. motors (as hereinafter defined), the tilt means also comprises an n.c. motor (as hereinafter defined), computer control means being provided by which said n.c. motors are controlled in accordance with programmed instructions in the form of digitised co-ordinate axis values. It will be appreciated that, using a computer-controlled system, not only the position but also the tilt condition of the device can be accurately controlled throughout its traverse along the marginal portions of the component regardless of the heightwise contour of the latter. By the term "n.c. motor" is to be understood a motor the operation of which is controlled by control signals supplied thereto in accordance with stored information appropriate to a desired operation.

In a computer-controlled apparatus, furthermore, preferably also the means for effecting relative movement of approach and separation between the support and the device comprises a third n.c. motor, said means also being effective, under the control of the computer control means, to cause the device to follow the heightwise contour of the exposed surface of a component supported by the support as relative lengthwise and widthwise movement is effected as aforesaid. Furthermore, by providing, in such an apparatus, a floating mounting for the nozzles housing and brush assembly, minor irregularities in the component heightwise contour can be accommodated while the general contour is followed by virtue of the third n.c. motor in response to the programmed instructions.

In order to achieve the desired degree of uniformity of applied adhesive, which is of course desirable in order to avoid wastage of adhesive on the one hand and "dry spots" within the adhesive stripe on the other, preferably the adhesive applicator device of the apparatus is capable of controlling the flow of adhesive from the outlet thereof. In addition, desirably the device is so constructed and arranged that any tendency (prevalent with many adhesive nozzles) for the adhesive to "drool" when the device is not is use should preferably be diminished if not indeed eliminated.

The invention further provides, in another of its aspects, an adhesive applicator for use in an apparatus as set out in the preceding paragraphs, said device comprising a nozzle having a housing in which a ball is accommodated for controlling the flow of adhesive through the housing and which has an end face providing an annular rim by which the ball is retained in the housing but which allows a portion of the ball to project beyond said end face, spring means being provided for urging the ball into a sealing position against the annular rim, thus to prevent the flow of adhesive from the nozzle, but the ball being movable against the spring pressure out of such sealing position, thus to allow adhesive flow, such movement of the ball being limited by an abutment such that a portion of the ball still projects beyond the end face of the housing a brush assembly bristles which extend in a direction lengthwise of the nozzle housing and which project beyond the end face thereof by a distance which can be set, the bristles being disposed about the whole of the periphery of said end face, and drive means for effecting rotation of the brush assembly about an axis extending lengthwise of the nozzle for spreading adhesive supplied from the nozzle.

It will be appreciated that, using the device in accordance with the invention, firstly the proximity of the ball to the end face of the nozzle housing means that no significant amount of adhesive remains "downstream" of the ball when the latter is moved into its sealing position, and thus drooling is effectively prevented. At the same time, when the ball is moved out of its sealing position to allow flow of adhesive as aforesaid, by controlling the retracted position of the ball, the flow of adhesive can be controlled. Furthermore, by providing the rotating brush assembly the spread of adhesive supplied from the nozzle is spread with a significant degree of.uniformity and, it has been found, with one edge of the applied adhesive forming a sharply defined line; in practice, this line arises where the spread-out bristles of the brush assembly are moving in a path which is parallel to the movement of the device as a whole.

The nozzle housing may be fixed against rotation while the brush assembly is mounted for rotational movement relative thereto, but in a preferred embodiment the brush assembly is secured to the nozzle housing and the drive means is operatively connected to the nozzle housing for effecting rotation of both the housing and the brush assembly, a rotary coupling being provided for connecting the nozzle to an adhesive supply. In this way, the nozzle housing and the brush assembly rotate as a unit with no relative movement therebetween, thus avoiding any problems which could otherwise arise by adhesive seeping between the parts were mounted for relative movement. Rotary couplings which are sealed against leakage are commercially available.

In using the device in accordance with the invention, it will be appreciated, urging the projecting ball portion against a workpiece to be coated with adhesive causes the ball to be retracted against the force of the spring means, thereby opening the nozzle to adhesive flow. As already mentioned it may be desirable, especially where the device forms part of an adhesive-applying apparatus, for the nozzle housing and brush assembly to "float" to a limited extent in order to overcome any irregularities in the surface to which adhesive is being applied. To this end, preferably the nozzle housing and the brush assembly are mounted for limited sliding movement in a direction lengthwise of the nozzle housing, and the drive means includes a drive connection by which such sliding movement is accommodated, spring means being provided, having a higher applied pressure than that of the spring means acting on the ball, for urging the nozzle housing and brush assembly in the direction of adhesive flow.

It will thus be appreciated that, by causing the nozzle housing and the brush assembly to float together, with no relative movement therebetween, the distance by which the bristles project beyond the end face of the nozzle housing remains constant, and thus the adhesive spread remains constant, regardless of the floating movement. The drive connection by which sliding movement is accommodated may be a simple pin-and-collar arrangement.

There now follows a detailed description, to be read with reference to the accompanying drawings, of an adhesive applicator device and of an adhesive-applying apparatus incorporating such device. It will of course be appreciated that this device and this apparatus have been selected for description merely by way of non-limiting example of the invention.

DESCRIPTION OF THE PREFERRED EMBODIMENT

Figure 7:
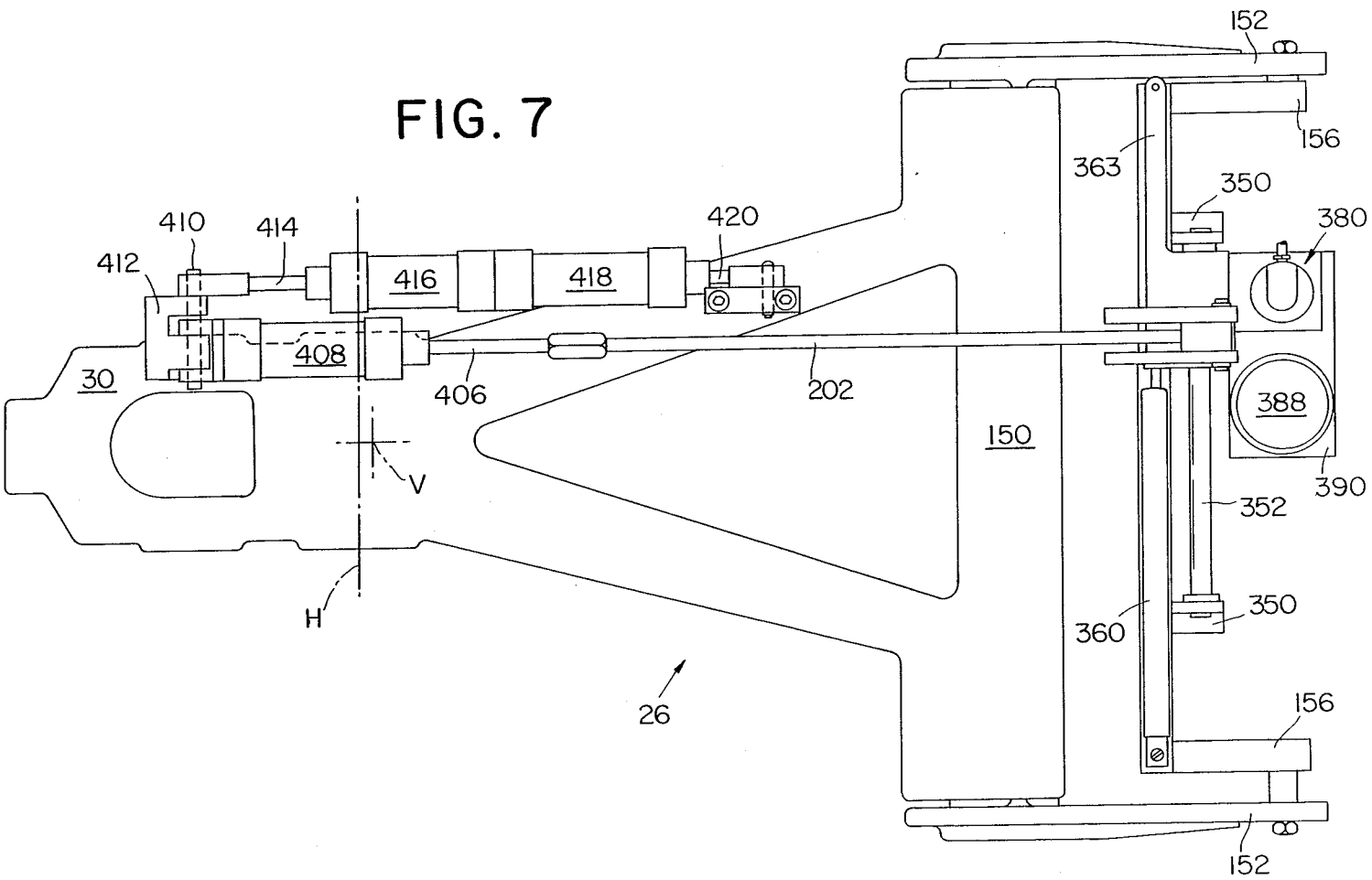
FIG. 7 is a fragmentary plan view of the apparatus, showing details of tilt means thereof.

The apparatus in accordance with the invention is generally similar, except as hereinafter described, to the apparatus described in EP-A No. 0091321 (itself a modification of the apparatus described in EP-A No. 0043645), which latter apparatus is a machine for performing a roughing operation progressively along marginal portions of a shoe bottom. The apparatus thus comprises a shoe support (not shown, but designated 18 in said specification) for supporting, bottom uppermost, a lasted shoe S, and a support column structure (not shown, but designated 22 in said specification) on which tool supporting means generally designated 26 is supported for pivotal movement about a horizontal axis H (FIG. 7) extending transversely of the bottom of a shoe supported by the shoe support and also about a vertical axis V, while the shoe support is mounted for pivotal movement about a horizontal axis (not shown) generally parallel to the axis H. It will thus be appreciated that, in the operation of this apparatus, the shoe support pivots about its shaft to move a shoe S supported thereby in a direction extending generally lengthwise of the shoe bottom, while the tool supporting means 26 is capable of pivotal movement about the two axes thus to move the tool supported thereby widthwise and heightwise of the shoe bottom, as the shoe support is moved as aforesaid. For effecting such movements furthermore, the apparatus comprises a first n.c. motor (not shown, but designated 144 in EP-A No.0043645) for effecting lengthwise movement of the shoe support, a second n.c. motor (84) for effecting widthwise movement of the tool relative to the shoe bottom, and a third n.c. motor (122) for effecting movement of the tool heightwise of the shoe support.

As described in detail in EP-A No. 0043645, the apparatus in accordance with the preesnt invention is computer-controlled, the computer having a storage memory for storing digitised information relating to a number of selected styles of shoe bottoms to be operated upon, the operator selecting, by means of a keyboard (not shown), the appropriate style for the next shoe to be operated upon. The computer is thus effective to cause the tool to follow a pre-determined path defined by three axes in accordance with the selected digitised information progressively along marginal portions of the shoe bottom, by appropriate signals to the various n.c. motors.

It will be thus appreciated that the apparatus in accordance with the present invention is generally similar to the machine described in EP-A No. 0043645 and EP-A No. 0091321 except that the two roughing brushes of the latter apparatus have been replaced by the adhesive applicator device generally designated 20 of the present invention.

Figure 1:
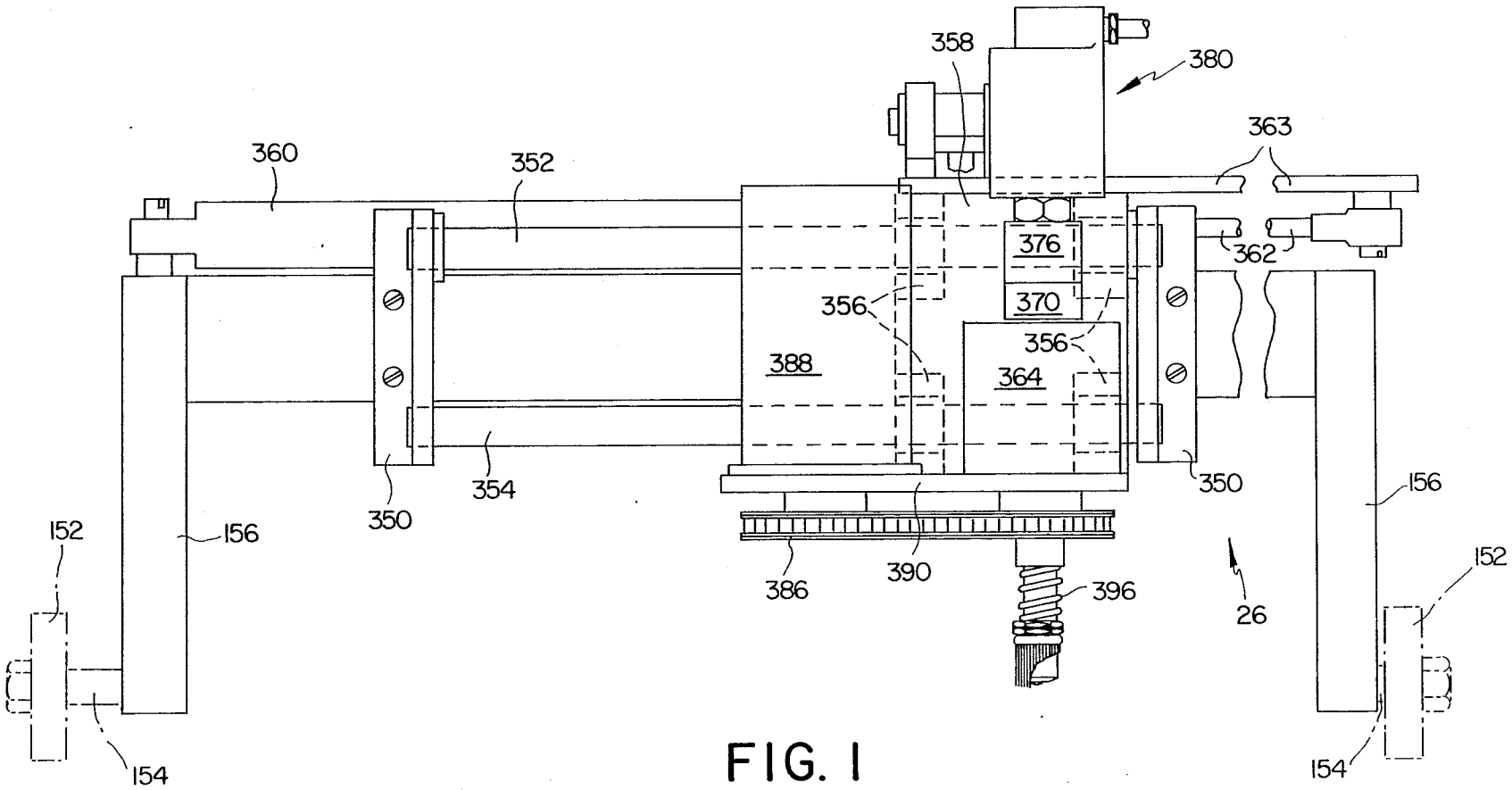
FIG. 1 is a fragmentary front view of the apparatus in accordance with the invention, showing the mounting of the device in accordance with the invention.
Figure 2:
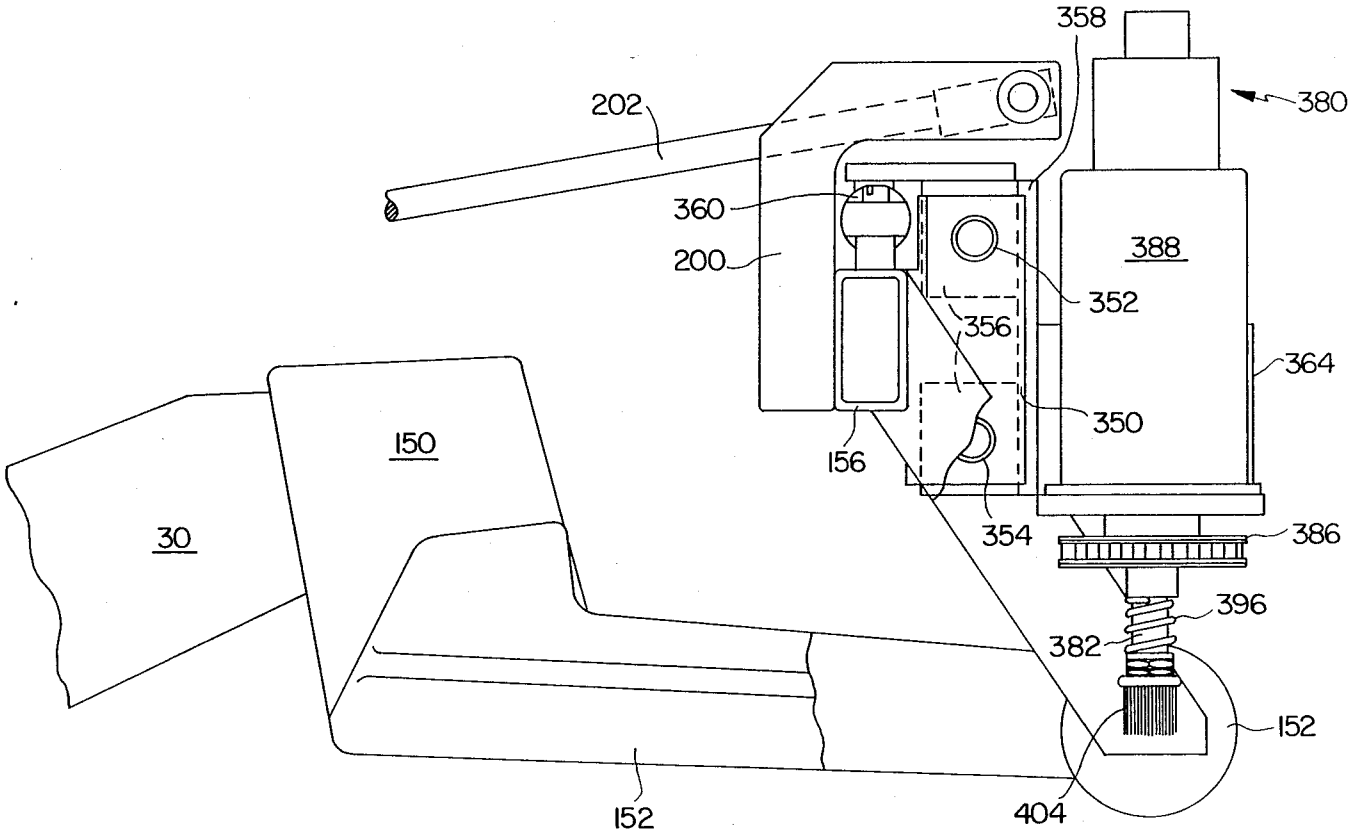
FIG. 2 is a side view of the parts shown in FIG. 1.

The tool support means comprises a transversely extending bridge member 150 (FIGS. 1, 2 and 7) supporting, at each of the opposite ends thereof, a forwardly projecting arm 152, there being supported, by means of fulcrum pins 154, at the forward end of each arm 152, a generally U-shaped cradle comprising a cross-beam 156. Supported centrally of the cross-beam 156 are two brackets 350 between which extend an upper and a lower slide rod 352, 354, on which, b means of four slide blocks 356, a vertical plate 358 is mounted for sliding movement between two end positions determined by abutment of the plate with stop faces provided on the brackets 350. The end positions of the plate are such that the alignment of the centreline of the device (20) supported thereby is such that it corresponds with centrelines of each of the two roughing brushes of the apparatus described in EP-A No. 00043645, so that the same digitised information may be used as has been developed for use with the roughing brushes, and indeed the device follows the same operating path along each side of the shoe bottom as did the roughing brushes in said apparatus, the arrangement being such that, in response to a signal that the operation along one marginal portions is completed, the plate 358 is automatically moved to its other end position for the return traverse of the shoe bottom along the opposite marginal portion. For effecting such sliding movement of the plate 358, a piston-and-cylinder arrangement 360 is mounted on the cross-beam and its piston rod 362 is attached to an arm 363 mounted on one of the slide blocks 356.

If desired, instead of mounting the plate 358 for sliding movement as aforesaid, the plate may be fixed to the cross-beam 156, and in that case the digitised information which has been developed for the roughing apparatus has to be modified to take account of the centrally mounting of the device.

Figure 3:
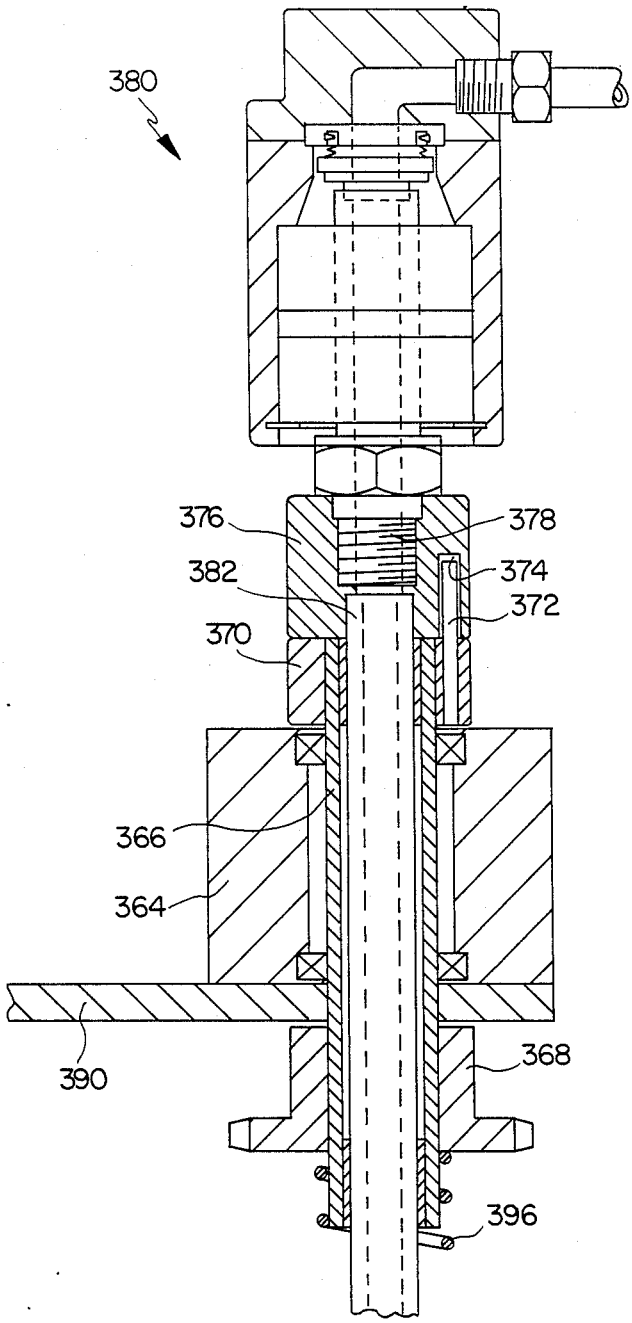
FIG. 3 is a view, partly in section, showing details of the device in accordance with the invention.
Figure 4:
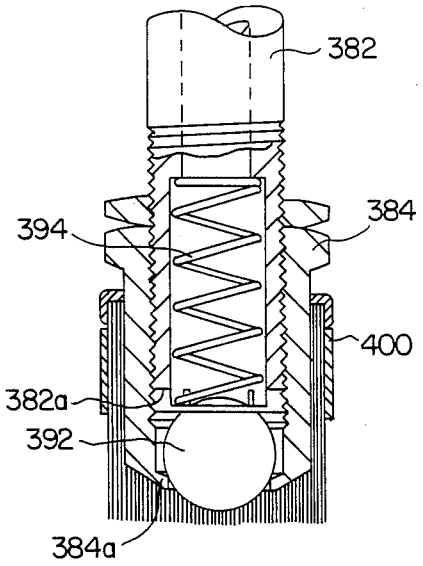
FIGS. 4 and 5 are fragmentary views showing a ball of the device respectively in its sealing position and moved out of its sealing position by engagement with a component.
Figure 6:
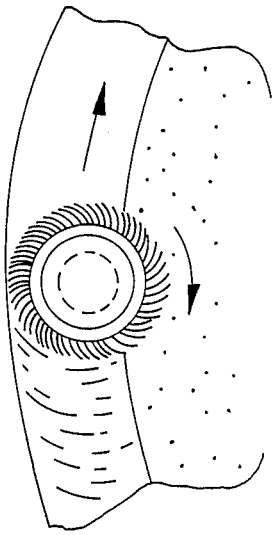
FIG. 6 is a fragmentary plan view showing the spreading effect achieved by pressing bristles of the device against a component while effecting rotation thereof.
Figure 5:
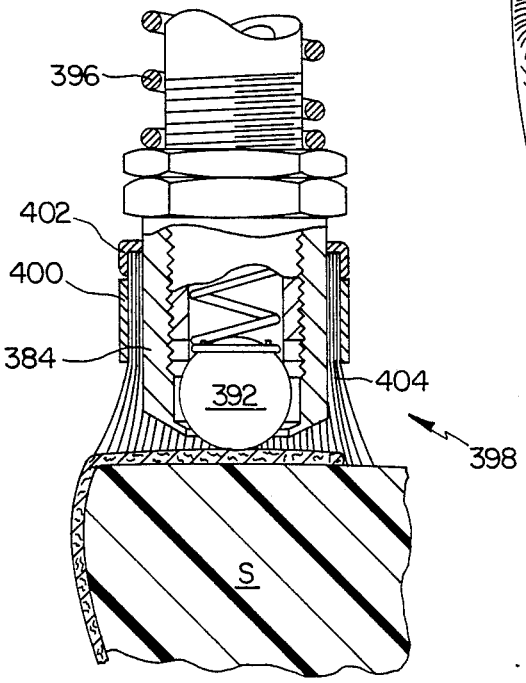

The adhesive applicator device 20 is mounted on the plate 358 in the following manner: Fixed to the front face of the plate 358 is a bearing block 364 (see FIG. 3) in which is rotatably mounted a hollow shaft 366 carrying at its lower end a sprocket 368 by which drive is imparted to the shaft (as will be hereinafter described). At its upper end the shaft carries a collar 370 in which is secured an upstanding pin 372 accommodated in a bore 374 of a further collar 276 which is threadedly secured to an output end 378 of a rotary coupling generally designated 380; one such coupling is available commercially from Deublin Limited. Force-fitted into the collar 376, furthermore, is the upper end of an adhesive supply tube 382 which passes through the hollow shaft 366 and has screw-threaded on the lower thereof a nozzle housing 384 (see FIGS. 4 and 5). It will thus be appreciated that rotation of the sprocket 368 causes, through the pin and bore 372, 374, rotation of the tube 382 and thus of the nozzle housing 384 secured thereto. For effecting such rotation, the sprocket 368 is connected by a chain 386 (FIG. 1) to an output drive of an electric motor 388 which is carried on a support plate 390 supported on the underside of the bearing block 364.

The nozzle housing 384 has a frustoconical lower end face 384*a* which provides an annular rim spaced from the lower end face 382*a* of the tube 382 to form therein a chamber in which a ball 392 is accommodated with a portion thereof projecting beyond the annular rim. A spring 394 is accommodated in a counter-sink formed in the lower end of the tube 382 and urges the ball against the annular rim into a sealing position in which adhesive flow through the nozzle is prevented. The application of pressure to the projecting portion of the ball 392, on the other hand, causes it to retract against the lower end 382*a* of said counter-sink, which is slotted so as to allow adhesive flow from the tube when the ball is urged thereagainst, such adhesive then flowing over the surface of the ball and out between the annular rim and the projecting portion of the ball.

It will thus be appreciated that, in using the device in accordance with the invention, pressing the ball 392 against a component to be coated with adhesive causes the ball to retract, to allow adhesive to be supplied through the nozzle, the supply continuing until the ball is moved out of contact with the component whereupon sealing takes place substantially immediately with consequent cut-off of the adhesive. The ball is shown in its retracted condition in FIG. 5.

The nozzle housing 384 is capable of "floating"relative to the bearing block 364, that is to say excessive pressure applied to the ball is accommodated by sliding movement of the nozzle housing bodily in relation to the hollow shaft 366, so that any irregularities in the surface of the shoe bottom to be coated with adhesive, in relation to the heightwise path as determined by the third n.c. motor, can be accommodated. To ensure that the nozzle housing is urged into its lowered position, a further spring 396 is provided acting between the nozzle housing and the underside of the hollow shaft. It will of course be appreciated that the force applied by the spring 396 is significantly greater than that applied by the spring 394, so as to ensure that the ball will first retract when engaged.

For spreading the adhesive which is supplied through the nozzle, a brush assembly generally designated 398 is secured to the outside of the nozzle housing 384, e.g. by a Jubilee clip 400. The brush assembly 398 comprises a ring 402, e.g. of plastics material, which is slid along the nozzle housing and in which are embedded sets of bristles 404 arranged to form a cylindrical shape which surrounds the nozzle housing and projects beyond the end face 384*a*, being disposed about the whole of the periphery of said end face 384*a*. By virtue of its being fixed to the housing as aforesaid, the brush assembly 398 rotates with the nozzle housing 384.

When the device is in use, in the operation of the apparatus in accordance with the invention, it has been found that the stripe of adhesive which is applied has a sharply defined edge where the movement of the bristles 404, as the brush assembly rotates, is parallel the direction of movementof the device bodily along its path, whereas the opposite edge of the stripe of adhesive tends to be "blobby". This is accounted for in that the spreading of the bristles as they are pressed against the component surface during the application of adhesive (see FIG. 5) is more closely controlled at the sharply defined edge, whereas there is a tendency at the other edge.

In operating on marginal portions of shoe bottoms, it is clearly desirable that a sharply defined edge is provided along the outside edge of the shoe bottom, since it is important firstly to ensure that the adhesive stripe adequately covers the whole of the area in which a bond is desired between the shoe bottom and an outsole, but where it is undesirable, in terms of the appearance of the finished shoe, for the adhesive to extend beyond that area. In EP-A No. 0091321 the path followed by each roughing brush is described and illustrated; more particularly the shoe support comprises an inductance sensing device 610 which is caused to generate a signal according to whether a shoe supported by the support is a left or a right, and in accordance with this signal the operation of the roughing brushes takes place so as to ensure that roughing is effected along the inside waist region always in one direction (in casu from the heel end to the toe end) and in the opposite direction along the outside waist region, so that uniformity of roughing can be achieved in a pair of shoes. This feature of shoe sensing is also preserved in the apparatus in accordance with the present invention and consequently the motor 388 is a reversible motor and the signal received according to whether the shoe is a left or a right determines the direction of rotation of the brush assembly 398. The preferred direction of rotation of the brush to provide the desired sharply defined edge has been found to be dependent upon the nature of the surface to which adhesive is applied. Thus in one mode of operation of the machine the direction of rotation selected is such that the portion of the bristles which precedes the ball, as the device follows it path, is always such as to cause the bristles 404 to wipe inwardly away from the outer edge of the shoe bottom; in other words, if the device follows a clockwise path around the shoe bottom, the rotation of the brush assembly is also clockwise and vice versa. Alternatively, with other surfaces it has been found desirable that the direction of rotation of the brush is reversed.

For operating on shoes having a significant three-dimensional contour, e.g. ladies'high-heeled shoes, it has been found desirable to tilt the device bodily about an axis extending transversely of the shoe bottom in order to maintain the central axis of the nozzle vertical or substantially so to the shoe bottom portion at which it is operating. This feature of tilt is also disclosed in EP-A No. 0043645, an n.c. motor (designated 232) being provided for effecting such tilt, through an arrangement of rods connected to a link 202 which is pivotally connected to a bracket 200 mounted on the cross-beam 156, to cause the latter to pivot about the fulcrum pins 154. Using an n.c.motor in this manner allows infinite variability of the tilt position. Such an arrangement can thus also be utilised in the apparatus in accordance with the present invention.

An alternative embodiment is shown in the drawings, which embodiment provides for a plurality of (in casu four) pre-set tilt positions. In this alternative embodiment, the link 202 is connected to the piston rod 406 (FIG. 7) of a first piston and cylinder arrangement 408 which is pivotally mounted, by means of a pivot pin 410, on a bracket 412 itself pivotally mounted on the arm 30 of the tool supporting means. Connected to the pivot pin 410 is a piston rod 414 of a piston-and-cylinder arrangement 416 which is arranged back-to-back with a further piston-and-cylinder arrangement 418 a piston rod 420 of which is pivotally secured to the arm 30. Each of the piston-and-cylinder arrangements 408, 416, 418 is of the same stroke (in casu 40 mm). This arrangement is thus effectively a system whereby the position of the pivot 410 is varied according to whether piston rods 414, 420 are extended or not, giving three positions for the pivot 410, and in addition the overall length of piston-and-cylinder arrangement 406, 408 and the link 202 is varied according to whether piston rod 406 is extended or not. Because of duplication of positions where each cylinder has the same stroke, this gives an overall possibility of four different positions for the cross-beam 150 and thus four different tilt positions for the device. Control of the three piston-and-cylinder arrangements 408, 416, 418 is under computer control in accordance with programmed instructions.

In certain cases, furthermore, it may be desirable to effect tilting movement of the nozzle about an axis extending lengthwise of the shoe bottom, thus to accommodate variations in the transverse contour of the shoe bottom. In such a case it has been found sufficient to provide for three pre-set tilt positions, although infinite variability or alternatively a larger number of pre-set positions could be provided.

As my invention I claim:

1. Adhesive-applying apparatus whereby adhesive is applied to marginal portions of components, comprising:

a support for supporting a component with a surface thereof exposed to marginal portions of which adhesive is to be applied;

an adhesive applicator device;

means for effecting relative movement of approach and separation between the support and the device to bring the device into operative engagement with a component supported by the support;

means for effecting relative movement between the support and device in directions both lengthwise and widthwise of the exposed surface of a component supported by the support whereby the device is caused to follow a desired path along a marginal portion of said surface, wherein the device comprises:

a nozzle having an end face providing an outlet through which adhesive can flow and which is provided with control means for controlling the flow of adhesive therethrough, said end face constituting an abutment which is moved into operative engagement with the surface of the component when relative movement of approach is effected between the support and the device as aforesaid;

a brush assembly comprising bristles which extend in a direction lengthwise of the nozzle, which are disposed about the whole of the periphery of the nozzle, and which project beyond the end face of the nozzle such that when said end face is brought into operative engagement with the component surface, the bristles are caused to deflect; and drive means for effecting rotation of the brush assembly about an axis extending lengthwise of the nozzle whereby the bristles are deflected, generally in a direction according to the direction of rotation of the brush, thus to spread over the marginal portions of the component the adhesive supplied onto the component surface through the outlet of the nozzle.

2. Apparatus according to claim 1 wherein the drive means comprises a reversible motor and further wherein means is provided by which, in accordance with the direction of relative lengthwise movement between the support and device along a marginal portion of the surface of a component as aforesaid, the direction of rotation of the brush assembly is determined.

3. Apparatus according to claim 2 wherein the support is adapted to support a lasted shoe with the bottom thereof uppermost, and further wherein the means for determining the direction of rotation of the brush assembly is constituted by means for determining whether the shoe to be operated upon is a left or a right.

4. Apparatus according to claim 3 wherein said means is also effective to determine the direction of relative lengthwise movement between the support end device.

5. Apparatus according to claim 2 wherein the brush assembly is caused by the drive means to rotate in a direction such that the bristles preceding the nozzle, as relative lengthwise movement takes place between the support and device, wipe inwardly away from the edge of the component surface.

6. Apparatus according to claim 1 wherein the device is mounted for tilting movement about an axis extending transversely of the support and tilt means is provided for effecting such tilting movement.

7. Apparatus according to claim 6 wherein the tilt means is effective to move the device to one of a plurality of pre-set tilt conditions.

8. An apparatus according to claim 6 wherein the means for effecting relative lengthwise and widthwise movement between the support and the device comprises first and second n.c. motors and the tilt means comprises a further n.c. motor, computer control means being provided by which said n.c. motors are controlled in accordance with programmed instructions in the form of digitised instructions.

9. An apparatus according to claim 8 wherein the means for effecting relative movement of approach and separation between the support and the device comprises a third n.c. motor, said means also being effective, under the control of the computer control means, to cause the device to follow the heightwise contour of the exposed surface of a component supported by the support as relative lengthwise and widthwise movement is effected as aforesaid.

10. An apparatus according to claim 1 wherein the support is adapted to support a lasted shoe with the bottom thereof exposed.

11. Adhesive applicator device comprising a nozzle having a housing in which a ball is accommodated for controlling the flow of adhesive through the housing and which has an end face providing an annular rim by which the ball is retained in the housing but which allows a portion of the ball to project beyond said end face, spring means being provided for urging the ball into a sealing position against the annular rim, thus to prevent the flow of adhesive from the nozzle, but the ball being movable against the spring pressure out of such sealing position, thus to allow adhesive flow, such movement of the ball being limited by an abutment such that a position of the ball still projects beyond the end face of the housing, a brush assembly comprising bristles which extend in a direction lengthwise of the nozzle housing and which project beyond the end face thereof by a distance which can be set, the bristles being disposed about the whole of the periphery of said end face, and drive means for effecting rotation of the brush assembly about an axis extending lengthwise of the nozzle for spreading adhesive supplied from the nozzle.

12. A device according to claim 11 wherein the brush assembly is secured to the nozzle housing and the drive means is operatively connected to the nozzle housing for effecting rotation of both the housing and the brush assembly, a rotary coupling being provided for connecting the nozzle to an adhesive supply.

13. A device according to claim 11 wherein the nozzle housing and the brush assembly are mounted for limited sliding movement in a direction extending lengthwise of the nozzle housing, and the drive means includes a drive connection by which such sliding movement is accommodated, spring means being provided, having a higher applied pressure than that of the spring means acting on the ball, for urging the nozzle housing and brush assembly in the direction of adhesive flow.

14. A device according to claim 11 wherein the drive means comprises a reversible electric motor acting through a chain-and-sprocket connection.

15. Adhesive-applying apparatus whereby adhesive is applied to marginal portions of components, comprising:

a support for supporting a component with a surface thereof exposed to which adhesive is to be applied;

an adhesive applicator device;

means for effecting relative movement of approach and separation between the support and the device to bring the device into operative engagement with the component supported by the support;

means for effecting relative movement between the support and the device in directions both lengthwise and widthwise of the exposed surface of a component supported by the support whereby the device is caused to follow a desired path along a marginal portion of said surface, wherein the device comprises:

a nozzle having a housing in which a ball is accomodated for controlling the follow of adhesive through the housing and which has an end face providing an annular rim by which the ball is retained in the housing but which allows a portion of the ball to project beyond said end face, spring means being provided for urging the ball into a sealing position against the annular rim, thus to prevent the flow of adhesive from the nozzle, but the ball being movable against the spring pressure out of such sealing position, thus to allow adhesive flow, such movement of the ball being limited by an abutment such that a position of the ball still projects beyond the end face of the housing;

a brush assembly comprising bristles which extend in a direction lengthwise of the nozzle housing and which project beyond the end face thereof by a distance which can be set, the bristles being disposed about the whole of the periphery of said end face; and drive means for effecting rotation of the brush assembly about an axis extending lengthwise of the nozzle for spreading adhesive supplied from the nozzle.

16. A device according to claim 15 wherein the brush assembly is secured to the nozzle housing and the drive means is operatively connected to the nozzle housing for effecting rotation of both the housing and the brush assembly, a rotary coupling being provided for connecting the nozzle to an adhesive supply.

17. A device according to claim 15 wherein the nozzle housing and the brush assembly are mounted for limited sliding movement in a direction extending lengthwise of the nozzle housing, and the drive means includes a drive connection by which such sliding movement is accomodated, spring means being provided, having a higher applied pressure than that of the spring means acting on the ball, for urging the nozzle housing and brush assembly in the direction of the adhesive flow.

18. A device according to claim 15 wherein the drive means comprises a reversible electric motor acting through a chain-and-sprocket connection.

* * * * * *